US008080085B2

(12) United States Patent
Hughes et al.

(10) Patent No.: US 8,080,085 B2
(45) Date of Patent: Dec. 20, 2011

(54) METHODS AND APPARATUS FOR AN IONIZER

(75) Inventors: Donald M. Hughes, Tucson, AZ (US); Inuka D. Renstrom, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 444 days.

(21) Appl. No.: 12/417,850

(22) Filed: Apr. 3, 2009

(65) Prior Publication Data

US 2009/0293718 A1 Dec. 3, 2009

Related U.S. Application Data

(60) Provisional application No. 61/058,349, filed on Jun. 3, 2008.

(51) Int. Cl.
*B03C 3/36* (2006.01)

(52) U.S. Cl. ..... 95/58; 95/78; 96/52; 96/63; 361/233

(58) Field of Classification Search ..... 95/58, 78; 96/52, 60, 62, 63, 97; 361/225–235
See application file for complete search history.

(56) References Cited

U.S. PATENT DOCUMENTS

| | | | | |
|---|---|---|---|---|
| 3,411,025 | A * | 11/1968 | Marks | 310/11 |
| 4,239,505 | A * | 12/1980 | Drnevich | 95/78 |
| 4,344,776 | A * | 8/1982 | Yavnieli | 96/63 |
| 5,667,563 | A * | 9/1997 | Silva, Jr. | 96/50 |
| 5,847,917 | A | 12/1998 | Suzuki | |
| 5,914,454 | A * | 6/1999 | Imbaro et al. | 95/64 |
| 6,017,381 | A * | 1/2000 | Dunn et al. | 95/3 |
| 6,464,754 | B1 * | 10/2002 | Ford | 95/26 |
| 6,905,029 | B2 * | 6/2005 | Flagan | 209/210 |
| 6,989,050 | B2 * | 1/2006 | Ganeev et al. | 96/63 |
| 7,208,030 | B2 * | 4/2007 | Totoki | 96/19 |
| 2002/0152636 | A1 | 10/2002 | Ernst et al. | |
| 2007/0163440 | A1 * | 7/2007 | Kim et al. | 96/52 |
| 2007/0234901 | A1 * | 10/2007 | Pletcher et al. | 95/78 |

FOREIGN PATENT DOCUMENTS

| | | | |
|---|---|---|---|
| JP | 11297491 | A | 10/1999 |
| JP | 2006032055 | A | 2/2006 |

* cited by examiner

*Primary Examiner* — Richard L Chiesa
(74) *Attorney, Agent, or Firm* — The Noblitt Group, PLLC

(57) ABSTRACT

Methods and apparatus for an ionizer according to various aspects of the present invention include an amplifier disposed within an open ended housing. The air amplifier is used to supply an amplified airflow that may then be passed through an air neutralization system thereby neutralizing the amplified airflow before exiting the housing. A pressurized gas may be injected into an internal portion of the air amplifier where it is mixed with an ambient airflow before exiting the air amplifier as an amplified airflow.

20 Claims, 2 Drawing Sheets

METHODS AND APPARATUS FOR AN IONIZER

CROSS-REFERENCES TO RELATED APPLICATIONS

This application claims the benefit of U.S. Provisional Patent Application No. 61/058,349, filed Jun. 3, 2008, and incorporates the disclosure therein in its entirety by reference.

BACKGROUND OF INVENTION

Ionizers may be used at many locations in manufacturing facilities to reduce the potential for electrostatic discharge when assembling, testing, or repairing electrical devices and components. Cleanroom environments also use ionizers for similar reasons in addition to the need to reduce the likelihood of contamination. Many ionizers typically contain a brushed motor to generate airflow through the ionizer. As the brushes in the motors wear they contribute to an increase of sub micron level particulates ejected from the ionizer. These particulates pose a threat to the cleanliness level of the devices and/or components.

Previous attempts to reduce the likelihood of particulate contamination have included increasing the distance between the ionizer and the hardware being worked on, reducing the amount of time the ionizer operates, and reducing the flow rate through the ionizer. Additional filtration systems have also been added to the ionizers with limited success. Effectiveness of each of these methods may also be limited due to the location of the workstation or bench where work is performed in comparison to the location of the ionizer.

SUMMARY OF THE INVENTION

Methods and apparatus for an ionizer according to various aspects of the present invention include an amplifier disposed within an open ended housing. The air amplifier is used to supply an amplified airflow that may then be passed through an air neutralization system thereby neutralizing the amplified airflow before exiting the housing. A pressurized gas may be injected into an internal portion of the air amplifier where it is mixed with an ambient airflow before exiting the air amplifier as an amplified airflow.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described herein in terms of functional block components and various processing steps. Such functional blocks may be realized by any number of hardware or software components configured to perform the specified functions and achieve the various results. For example, the present invention may employ various housings, connectors, couplings, e.g., such as electrical connections, pneumatic quick connects, and the like, which may carry out a variety of functions. In addition, the present invention may be practiced in conjunction with any number of repair or manufacturing facilities such as a cleanroom workstation or a test bench, and the system described is merely one exemplary application for the invention. Further, the present invention may employ any number of conventional techniques for entraining and neutralizing airflow.

Figure 1:
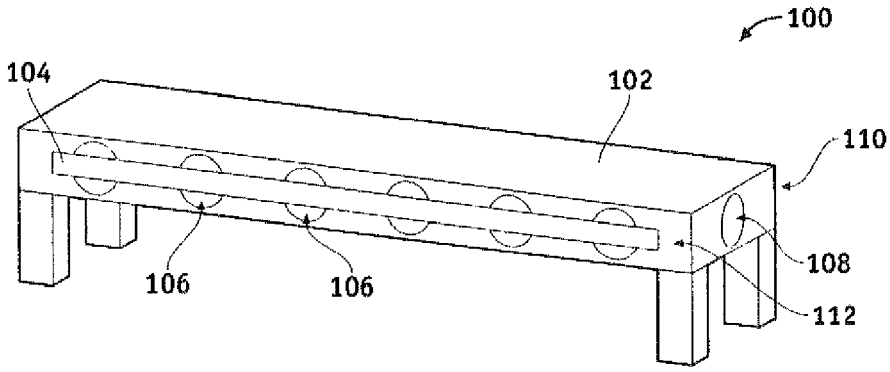
FIG. 1 representatively illustrates an ionizer in accordance with an exemplary embodiment of the present invention.

Various representative implementations of the present invention may be applied to any workstation for general assembly or repair, manufacturing, and the like. Certain representative implementations may include, for example, a bench top workstation for use in a cleanroom assembly area and/or a workstation requiring protection against electrostatic discharge. Referring now to FIG. 1, methods and apparatus for an ionizer 100 according to various aspects of the present invention may operate in conjunction with a housing 102 and a supply of pressurized air.

The ionizer 100 may comprise any suitable system for providing a stream of neutrally charged air to an area such as a workstation. In one embodiment, the ionizer 100 may be configured without a motor or fan and be suitably adapted to operate atop a workbench. In another embodiment, the ionizer 100 may be adapted for use in a cleanroom whereby particulate matter originating from the ionizer 100 is not exhausted from the unit during operation. For example, in an embodiment configured for operation on a workbench in a cleanroom, individual components of the ionizer 100 may be comprised of non-corrosive materials such as stainless steel. Similarly, the ionizer 100 may be configured without materials such as bearing grease, brushed motors, paints, and the like which may degrade over time or from use.

Figure 2:
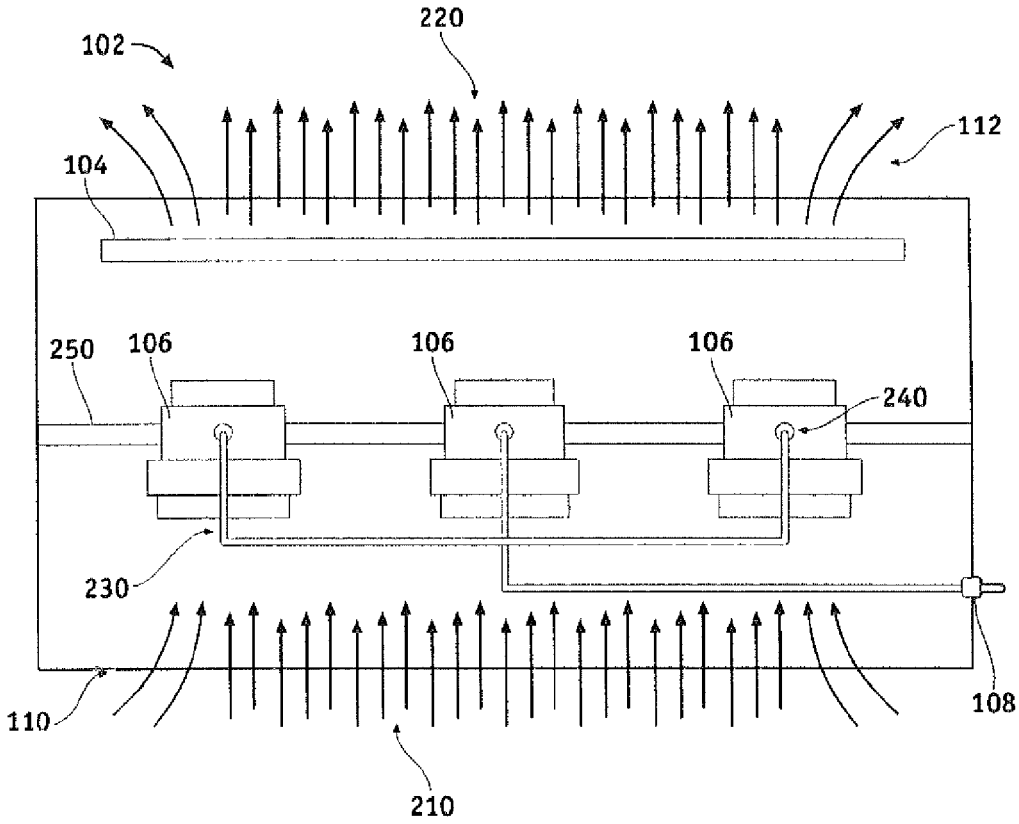
FIG. 2 representatively illustrates airflow through the ionizer.

The ionizer 100 may comprise an air amplifier 106 and an air neutralization system 104 at least partially enclosed within the housing 102. The air neutralization system 104 may be positioned between an output of the air amplifier 106 and a discharge end of the ionizer 100. Referring now to FIG. 2, the housing 102 may also comprise a pressurized gas line 230 suitably adapted to provide a pressurized air supply to the air amplifier 106. The ionizer 100 may be suitably configured to combine the pressurized gas with an incoming ambient airflow 210 to produce an entrained ionized airflow 220 free from particulates.

The housing 102 at least partially encloses the air amplifier 106 and the air neutralization system 104. The housing 102 may also be configured to controllably direct the ionized airflow 220 as it exits the housing 102. Referring again to FIG. 1, in one embodiment, the housing 102 may comprise a substantially rectangular box with a first open end 110 and a second open end 112. In an alternative embodiment, the housing 102 may comprise any suitable shape, size, or internal volume.

The housing 102 may also be suitably configured to allow a free path between the first open end 110 and the second open end 112 for an airflow during operation and/or when not in use. In an embodiment which does not have a motor, fan, or other moving parts, the housing may also be configured without a safety guard on either or both of the open ends 110, 112.

The housing 102 may be configured to be operated in any suitable location such as a workbench or atop a table and may be configured for permanent or semi-permanent attachment. For example, the housing 102 may be configured to mount on a wall or attach to or hang from a ceiling.

Figure 3:
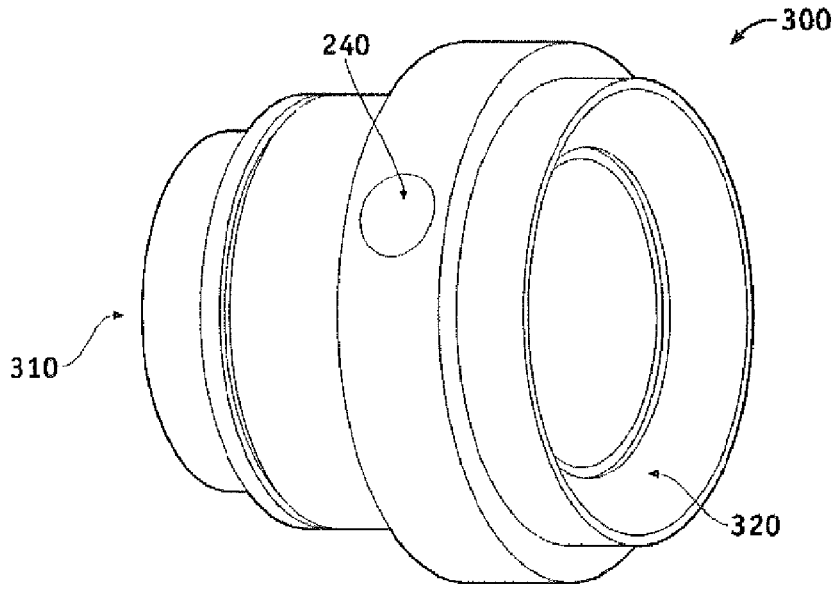
FIG. 3 representatively illustrates a trans vector.
Figure 4:
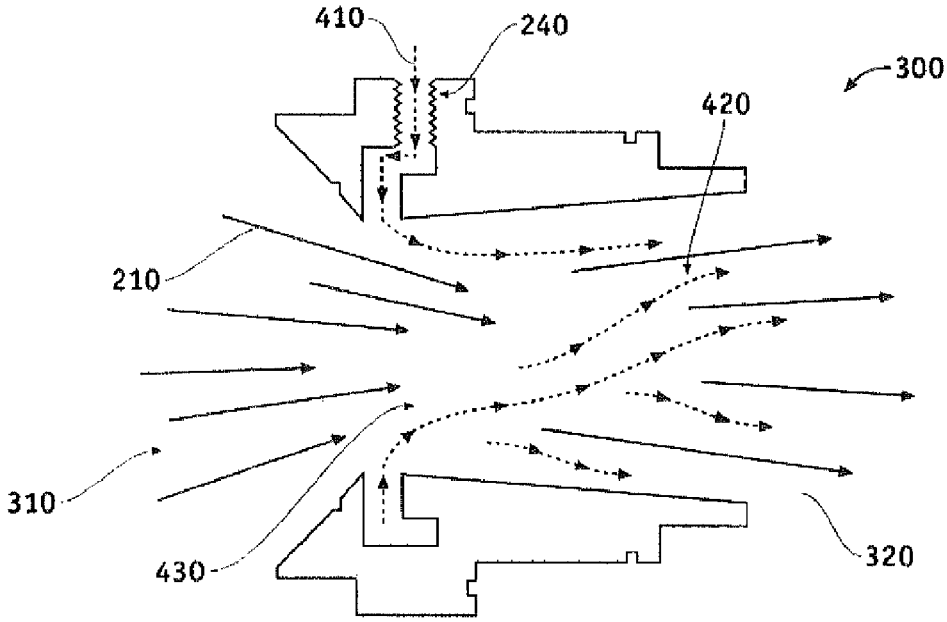
FIG. 4 representatively illustrates a cross-sectional view of a transvector.

Referring now to FIGS. 2, 3 and 4, the air amplifier 106 affects an increase to a mass flow rate of air from the first open end 110 of the housing 102 to the second open end 112 of the housing 102. The air amplifier 106 may comprise any suitable system for increasing a mass flow rate of air. For example, referring to FIG. 3, in one embodiment, the air amplifier 106 may comprise a transvector 300 comprising an inlet end 310, a discharge end 320, and a pressurized gas connection point 240. The transvector 300 may also comprise an internal nozzle structure such as a converging-diverging nozzle. The pressurized gas line 230 may be used to supply a pressurized gas 410 to an internal venturi section 430 of the transvector 300 through the gas connection point 240. The pressurized gas 410 may then mix with an ambient airflow 210 which enters the transvector 300 through the inlet end 310. The two fluids may be mixed in the venturi section 430 of the transvector 300 in such a manner that the combined result is a unidirectional entrained amplified airflow 420 moving towards the discharge end 320 of the transvector 300.

The air amplifier 106 may be disposed within the ionizer by any suitable method such as in a manifold or other suitable structure. For example, referring again to FIG. 2, the housing 102 may comprise a box comprising the first open end 110 and the second open 112 with a plurality of air amplifiers 106 arranged horizontally in a manifold 250. Alternatively, one or more air amplifiers 106 may be arranged in any suitable pattern such as multiple rows, a circular pattern, or a grid layout.

The air amplifier 106 may also comprise any suitable material such as metal or a metallic alloy. For example, one embodiment of the present invention may be configured for use in a clean room environment necessitating the need for a metal such as stainless steel or aluminum, in another embodiment where a requirement on potential particulates is less strict, the air amplifier 106 may be comprised of a nonconductive plastic such as a molded polymer.

The gas connection point 240 receives the pressurized gas 410 and directs it to the venturi section 430. The gas connection point 240 may comprise any suitable system for connecting the pressurized gas line 230 to the air amplifier 106. For example, referring to FIG. 4 of the present embodiment, the gas connection point 240 may comprise a threaded sleeve suitably configured to receive a threaded insert coupled to the pressurized gas line 230.

The pressurized gas 410 is used to amplify and entrain the ambient airflow 210. The pressurized gas 410 may comprise any suitable fluid such as compressed ambient air, inert gasses, or the like. For example, in one embodiment, the pressurized gas 410 may comprise an inert gas such as nitrogen. In a second embodiment, the pressurized gas 410 may comprise standard shop air that has been compressed to a higher pressure. If a gas such as nitrogen is used for the pressurized gas 410, the housing 102, the air amplifier 106, and/or the manifold may also be adapted to ensure that the amplified airflow 420 does not result in a low oxygen condition which could negatively affect nearby persons.

The pressurized gas 410 may also be used to control a mass flow rate of the amplified airflow 420. For example, a pressure controller may be coupled to the pressurized gas 410 and be configured to control the pressure and/or flow rate of the pressurized gas 410 released into the air amplifier 106. The pressure controller may comprise any suitable system for adjusting the pressure and/or flow rate of the pressurized gas 410 such as a valve that is either manually controlled or electronically controlled. In one embodiment, the flow rate of the amplified airflow 420 may be several times greater than the flow rate of the ambient airflow 210. In another embodiment, the amplified airflow 420 may be adjustable to between fifteen and twenty times greater than that of the ambient airflow 230. In yet another embodiment, the rate of the amplified airflow 420 may be adjustable to any value greater than or equal to rate of the ambient airflow 210.

The operation of the ionizer 100 may also be controlled by the flow of the pressurized gas 410. For example, if the flow rate of the pressurized gas 410 through the air amplifier 106 is zero, then the flow rate of air through the ionizer 100 may also be zero. If a mass flow rate of pressurized air 410 greater than zero is allowed to enter the air amplifier 106, then there may be a proportional level of amplified airflow 420 exiting through the second open end 112. The amplified airflow 420 may or may not be neutralized however as it exits the second open end 112. Neutralization or ionization of the amplified airflow 420 may be controlled by the air neutralization system 104. For example, the air neutralization system 104 may be automatically activated if the pressurized gas 410 is injected to the air amplifier 106. Alternatively, the air neutralization system 104 may be manually activated prior to or after the introduction of the pressurized gas 410.

The pressurized gas Hue 230 delivers pressurized gas to the air amplifier 106 to create the amplified airflow 420. The pressurized gas line 230 may comprise any suitable system for the delivery of pressurized gas such as a rigid or semi rigid tube, a duct, or a hose. The pressurized gas line 230 may comprise any suitable materials such as metals, polymers, or elastomer. For example, referring to FIG. 2, in one embodiment, the pressurized gas line 230 may comprise a manifold of stainless steel tubes disposed within the housing 102 to connect the gas connection point 240 to a coupling 108. The coupling 108 may be used to connect to an external pressurized gas source such as overhead utilities or to a nearby gas tank. Alternatively, the pressurized gas line 230 may be routed along portion of on the exterior of the housing 102.

The air neutralization system 104 neutralizes charged particles in the amplified airflow 420. The air neutralization system 104 may comprise any suitable system for altering the charged state of particles in the air. In the one embodiment, the air neutralization system 104 may comprise an electrically operated system suitably configured to function on standard 110V AC power. In another embodiment, the air neutralization system 104 may be configured to operate off DC power.

For example, in one embodiment, the air neutralization system 104 may comprise an ionization bar adapted to add positive and negative ions to the amplified airflow 420 creating the ionized airflow 220 before it exits the housing 102. The air neutralization system 104 may also be comprised of materials suitable for use in a clean room environment such as stainless steel or medical grade polycarbonates.

The air neutralization system 104 may be positioned downstream of the discharge end 320 of the air amplifier 106 such that the amplified airflow 420 passes through, over, past, or otherwise across the air neutralization system 104. For example, referring again to FIG. 2, the air neutralization system 104 may be mounted inside the housing 102 between the discharge end 320 of the air amplifier 106 and the second open end 112 of the housing 102.

In operation, an amplified airflow 420 may be created by injecting a pressurized gas 410 such as nitrogen into an air amplifier 106 disposed within a housing 102. The pressurized gas 410 may be injected into a venturi section 430 of the air amplifier 106 such that pressurized gas 410 expands and exits a discharge end 320 of the air amplifier. The discharge end 320 of the air amplifier 106 may comprise an expanding nozzle suitably configured to provide a path from the venturi section 430 in which the pressurized gas 410 may be accelerated drawing with it an ambient airflow 210 from an inlet section 310 of the air amplifier 106 forming the amplified airflow 420.

As the pressurized gas 410 expands and exits the air amplifier 106, it mixes with the ambient airflow 210 increasing the total mass flow rate of air passing through the housing 102. The total mass flow rate of air through the housing 102 may be at least partially controlled by the pressure of the pressurized gas 410 and/or the flow rate of the pressurized gas 410.

The amplified airflow 420 may then engage an air neutralization system 104 suitably configured to neutralize and/or ionize the amplified airflow 420. In one embodiment, the air neutralization system 104 may comprise an electrically operated ionization bar adapted to add positive and negative ions to the amplified airflow 420 forming an ionized airflow 220 that exits the housing 102.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An air ionizer comprising:

a housing with a first open end and a second open end, wherein:

the first open end adapted to receive an ambient airflow into the housing; and the second open end adapted to pass a neutralized airflow out of the housing;

an airflow amplifier disposed within the housing between the first and second open ends, wherein the airflow amplifier comprises:

an inlet configured to receive the ambient airflow;

a discharge end; and a pressurized gas connection configured to couple a pressurized gas source to the airflow amplifier, wherein a pressurized gas is mixed with the ambient airflow and discharged through the discharge end as an amplified airflow; and an air neutralization system disposed between the discharge end of the airflow amplifier and the second open end, wherein the air neutralization system neutralizes the amplified airflow.

2. An ionizer according to claim wherein the airflow amplifier comprises a transvector.

3. An ionizer according to claim 2, wherein a plurality of transvectors is coupled to a manifold disposed within the housing.

4. An ionizer according to claim 1, wherein the air neutralization system comprises an ionizer bar.

5. An ionizer according to claim 1, wherein the pressurized gas comprises an insert gas.

6. An ionizer according to claim 1, further comprising at venturi section between the inlet and the discharge end and configured to receive the pressurized gas.

7. An ionizer according to claim 1, wherein the housing is further configured to controllably direct the neutralized airflow.

8. An ionizer according to claim 1, wherein the housing further comprises a controller configured to adjust a mass flow rate of the amplified airflow.

9. An ionizer for a workstation, comprising:

a housing comprising a first open end and a second open end, wherein:

the first open end adapted to receive an ambient airflow; and the second open end adapted to supply an ionized airflow;

a transvector disposed within the housing between the first and second open ends, wherein the transvector comprises;

a body;

an inlet configured to receive the ambient airflow;

a discharge end; and a pressurized gas connector configured to couple a pressurized gas source to the body, wherein a pressurized gas from the pressurized gas source is routed through the body, mixed with the ambient airflow, and discharged through the discharge end as an amplified airflow; and an ionization system disposed between the discharge end of the transvector and the second open end, wherein the ionization system is adapted to ionize the amplified airflow.

10. An ionizer according to claim 9, wherein a plurality of transvectors coupled to a manifold disposed within the housing.

11. An ionizer according to claim 9, wherein the ionization system comprises an ionizer bar.

12. An ionizer according to claim 9, wherein the pressurized gas comprises an inert gas.

13. An ionizer according to claim 12, wherein the inert gas comprises nitrogen.

14. An ionizer according to claim 9, wherein the housing is further configured to controllably direct the ionized airflow.

15. An ionizer according to claim 9, wherein the housing further comprises a controller configured to adjust a mass flow rate of the amplified airflow.

16. A method of ionizing an airflow comprising:

disposing a transvector with an inlet end and a discharge end inside of a housing with a first open end and a second open end, wherein the inlet end is adapted to receive an ambient airflow entering the housing through the first open end;

injecting a pressurized gas into an internal portion of the transvector wherein the pressurized gas mixes with the ambient airflow to create an amplified airflow exiting the discharge end of the transvector; and ionizing the amplified airflow by an ionization system disposed between the discharge end of the transvector and the second open end of the housing.

17. A method of ionizing an airflow according to claim 16, further comprising coupling a plurality of transvectors to a manifold disposed at least partially within the housing.

18. A method of ionizing an airflow according to claim 16, wherein the ionization system comprises an ionizer bar.

19. A method of ionizing an airflow according to claim 16, further comprising controlling the direction of the ionized airflow after it exits the housing.

20. A method of ionizing an airflow according to claim 16, further comprising controlling a mass flow rate of the amplified airflow injected into the body of the transvector.

* * * * *